US005507674A

United States Patent [19]

Yeung

[11] Patent Number: 5,507,674

[45] Date of Patent: Apr. 16, 1996

[54] AQUATIC SYSTEM WITH PNEUMATIC DEVICES AND RELEASABLE COUPLING THEREBETWEEN

[75] Inventor: Man F. Yeung, Rowland Heights, Calif.

[73] Assignee: Sunco Products, Inc., Industry, Calif.

[21] Appl. No.: 301,684

[22] Filed: Sep. 7, 1994

[51] Int. Cl.[6] ..... B63C 9/08

[52] U.S. Cl. ..... 441/131; 114/266

[58] Field of Search ..... 114/266; 441/128–132; 5/441, 455, 456, 457

[56] References Cited

U.S. PATENT DOCUMENTS

| | | | |
|---|---|---|---|
| 67,039 | 7/1867 | Golding | 441/128 |
| 5,020,465 | 6/1991 | Langford | 441/129 |
| 5,167,554 | 12/1992 | Tager et al. | 441/129 |

FOREIGN PATENT DOCUMENTS

| | | | |
|---|---|---|---|
| 452784 | 5/1913 | France | 441/128 |
| 1501932 | 11/1967 | France | 114/266 |

*Primary Examiner*—Jesús D. Sotelo

[57] ABSTRACT

An aquatic device comprising a buoyant member which has a first surface and a second surface and a central plane therebetween. The buoyant member also has a peripheral edge therearound. Two pair of clips are included with each pair including a male member and a female member. The male and female member of each pair are spaced with respect to each other. Attachment elements are included to couple the clips to the peripheral edge of the buoyant member with one pair at a first location and the other pair at an opposite location.

2 Claims, 3 Drawing Sheets

AQUATIC SYSTEM WITH PNEUMATIC DEVICES AND RELEASABLE COUPLING THEREBETWEEN

BACKGROUND OF THE INVENTION

1. Field of the Invention

This invention relates to an aquatic system with pneumatic devices and releasable coupling therebetween and, more particularly, to releasably coupling pneumatic inner-tubes through releasably interconnectable clips on opposite sides of the tubes for the coupling of the tubes in any of a plurality of systems configurations.

2. Description of the Background Art

Presently, pneumatic and other aquatic devices are in common use today. Such devices typically promote games in water, particularly for children.

Aquatic devices take a wide variety of sizes and shapes. One of the more common shapes is that of a torus-shaped member. Such devices were at one time exclusively inner-tubes from automobiles. More recently, such devices are designed of a torus-like shape but specifically for entertainment of people enjoying aquatic activities.

Aquatic devices have for all practical purposes been limited to devices usable by themselves. This is despite the fact that people enjoying aquatic activities, may hold such devices together when playing games or participating in other entertaining activities. No effort has ever been made to couple such aquatic devices in systems configuration. Although aquatic devices may have been linked by a rope, cord or a string for a particular purpose, no aquatic device has ever been designed specifically for use either alone or in systems configuration with the same or similar type devices.

As evidenced by a large number of prior art patents, efforts are continuing to improve aquatic devices. Consider for example, U.S. Pat. No. 2,850,252 to Ford discloses an inflatable mat structure for non-aquatic uses while U.S. Pat. No. 5,238,231 to Huang discloses pneumatic shock-absorbing units interconnectable to form shock-absorbing structures.

U.S. Pat. No. 4,866,819 to Kasai discloses a buckle assembly with a male component and a female element while U.S. Pat. No. 4,825,515 to Wolterstorff discloses a safety buckle with laterally resilient locking elements.

Lastly, U.S. Pat. No. 4,894,033 to Chang discloses multipurpose and inflatable rafts with components usable individually or together through a system of clips. The clips allow like rafts to be selectively interconnected in but a single configuration.

As will become evident, nothing in the prior art provides the benefits and advantages attendant with the present invention.

Accordingly, it is an object of this invention to provide an improvement which overcomes the aforementioned inadequacies of the prior art devices and provides an improvement which is a significant contribution to the advancement of the art.

Another object of this invention is to selectively interconnect like or similar pneumatic devices in any of a plurality of configurations.

Another object of this invention is to form aquatic systems of various configurations through an array of male and female clips.

Lastly, another object of this invention is to provide an aquatic device comprising a buoyant member which has a first surface and a second surface and a central plane therebetween. The buoyant member also has a peripheral edge therearound. A plurality of clips are included with each pair including a male member and a female member. The male and female member of each pair are spaced with respect to each other. Attachment elements are included to couple the clips to the peripheral edge of the buoyant member with one pair at a first location and the other pair at an opposite location.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an aquatic system with pneumatic devices and releasable coupling therebetween comprising, in combination, a plurality of inflatable inner-tubes. Each inner-tube is formed in a torus-shaped configuration with a central circular aperture therethrough and a major axis extending through the center of the central aperture. The cross sectional configuration of each inner-tube is essentially circular with a circular minor axis located centrally therewithin. Each inner-tube has peripheral material in a central plane containing the minor axis and perpendicular to the major axis. A pair of channels are formed in the peripheral material at diametrically opposite sides of each inner tube. The channels on each side have tangential linear openings in the central plane and spaced circumferentially around the periphery of the inner-tube. A pair of clips are coupled to each side of each inner tube. Each pair includes a male member and a female member. Each member has an inboard post secured within an associated channel and also has an outboard end. The outboard ends of the clips for each pair include a male member and a female member. Each male member is in a flat generally rectangular configuration with a U-shaped cut and a linear resilient attached edge at its outboard end adjacent to the post forming a pivotable plate. Each male member also has a linear upstanding projection on the plate at the inboard end opposite from and parallel with the resilient edge. Each female member is in a flat generally rectangular configuration with a recess formed at its outboard end and extending inboardly thereof for the receipt of the outboard end of the male member. The female member has an opening in one face for the receipt of the upstanding projection of the male member and locking therebetween and to allow for the depression of the upstanding projection out of the opening and the separation of the male and female members. The male member also has a slanting cam surface on the outboard end of the upstanding projection to allow downward deflection thereof when the male member is inserted into the female member until the upstanding projection resiles into the opening.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several Figures.

DETAILED DESCRIPTION OF THE PREFERRED EMBODIMENT

Figure 1:
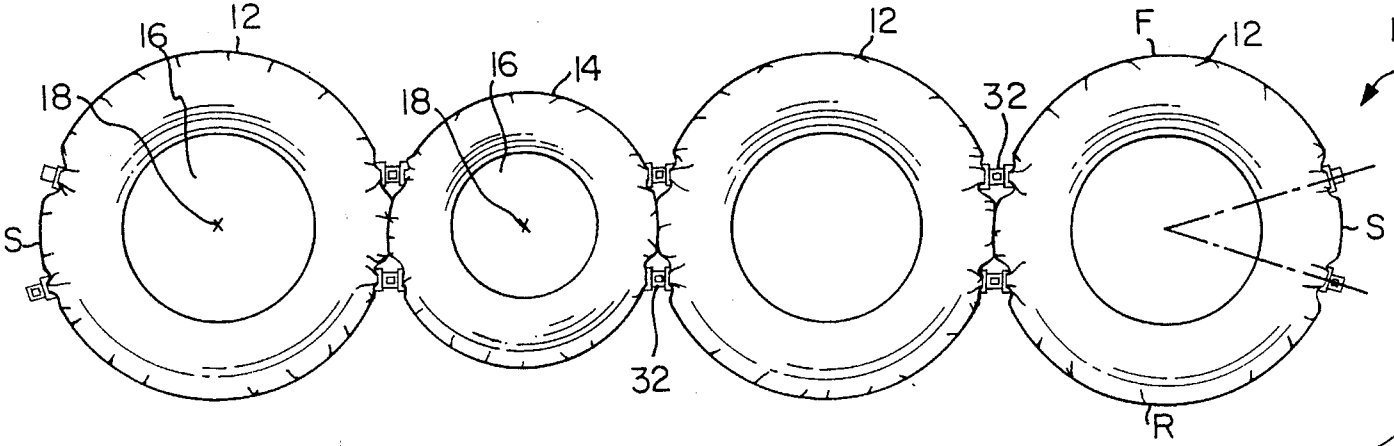
FIG. 1 is a perspective showing of the preferred embodiment of the new and improved aquatic system with pneumatic devices and releasable coupling therebetween constructed in accordance with the principles of the present invention.
Figure 2:
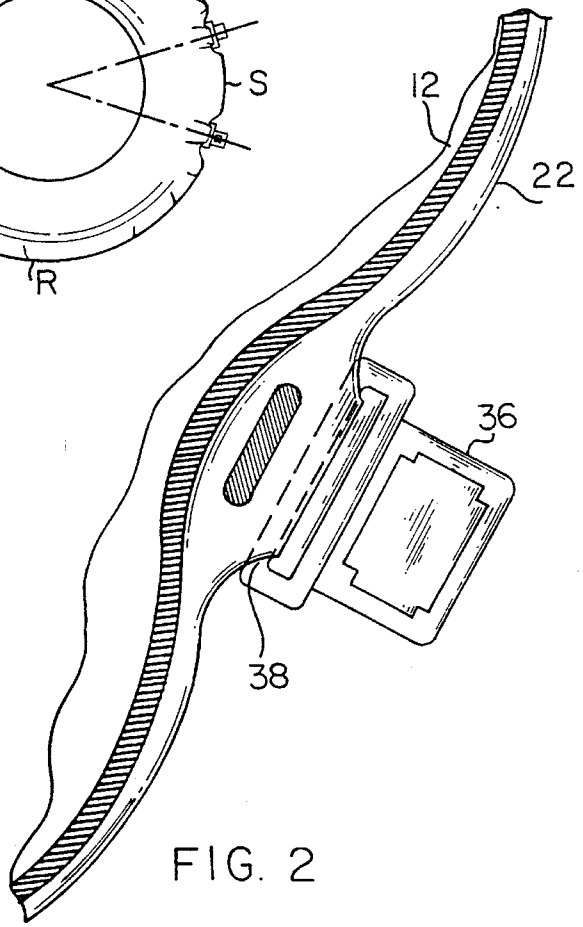
FIG. 2 is an enlarged plan view of one of the clips shown in FIG. 1 with an adjacent portion of an inner-tube.

With reference now to the drawings, and in particular to FIG. 1 thereof, a new and improved aquatic system with pneumatic devices and releasable coupling therebetween embodying the principles and concepts of the present invention and generally designated by the reference numeral 10 will be described.

The present invention, the new and improved aquatic system with pneumatic devices and releasable coupling therebetween, is comprised of a plurality of components. Such components in their broadest context include inner-tubes, pairs of channels in the inner-tubes, and pairs of clips including male members and female members. Such components are individually configured and correlated with respect to each other so as to attain the desired objective.

The system 10 of the present invention has as its central component a plurality of inflatable inner-tubes 12 and 14. Each inner-tube, whether large 12 or small 14, is formed in a donut or torus-shaped configuration. Such configuration includes a central circular apertures 16 therethrough. A major axis 18 extends through the center of the aperture 16 and is aligned perpendicular to the plane of the aperture.

Figure 6:
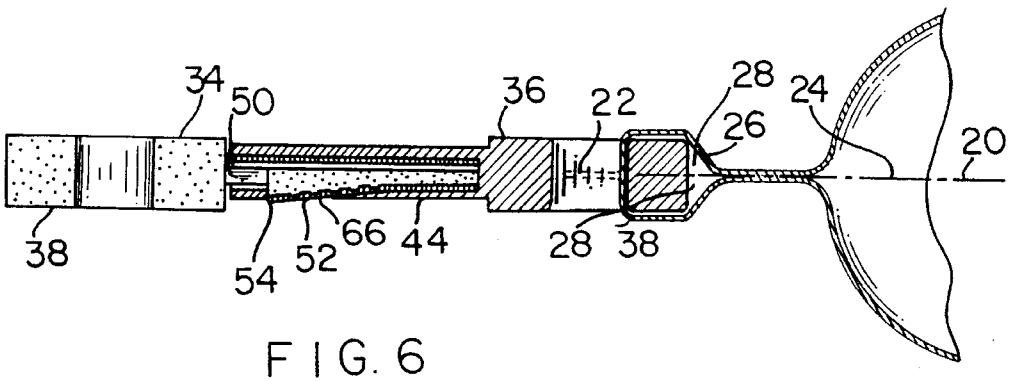
FIG. 6 is a cross sectional view of the clips shown in FIG. 5.
Figure 3:
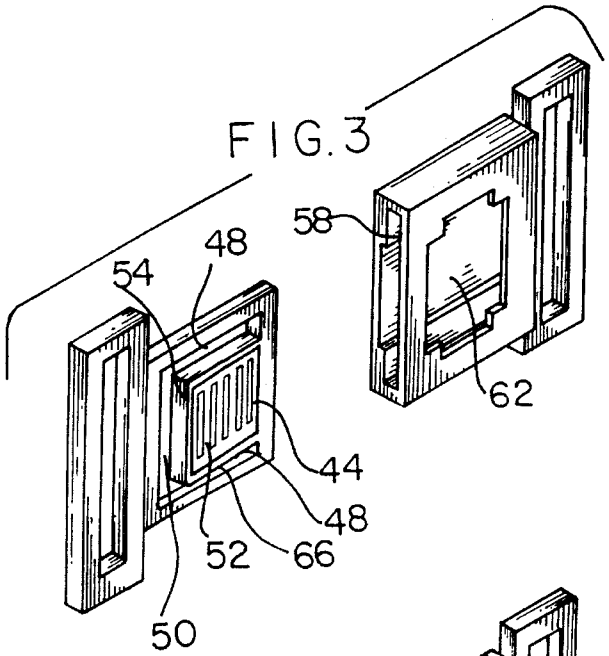
FIG. 3 is an exploded perspective illustration of a male and a female clip.

The cross sectional configuration of each inner-tube is essentially circular. Note FIG. 6. A circular minor axis 20 is located centrally within each circular cross sectional segment. Each inner-tube also has peripheral material 22 in a central plane 24. Such central plane 24 is that plane which contains the minor axis and is perpendicular to the major axis.

Formed within the peripheral material of each inner-tube are two pairs of channels 26. Such channels are located at diametrically opposed sides of each inner-tube. The channels on each side have linear openings 28 which are tangential to the periphery of the inner-tube. The channels are in the central plane 24 and spaced circumferentially around the periphery of each inner-tube.

The next major component of the system 10 are pairs of clips 32. The clips include pairs with one pair on each side of the inner-tube. Each pair includes a male member 34 and a female member 36. Each member has an inboard post 38 at its inboard end 40. Such post is secured within an associated channel. Each clip also has an outboard end 42. The outboard ends of the clips for each pair include the male member and the female member.

Each male member is in a generally flat rectangular configuration. Each male member also includes a U-shaped cut and a linear resilient attached edge 44 at its outboard end 42. The U-shaped cut includes parallel legs 48 and a coupling transverse leg 50. These cuts form a pivotable plate 52. Each plate also has a linear upstanding projection 54 on the plate at its inboard end opposite from and parallel with the resilient edge 44.

Figure 5:
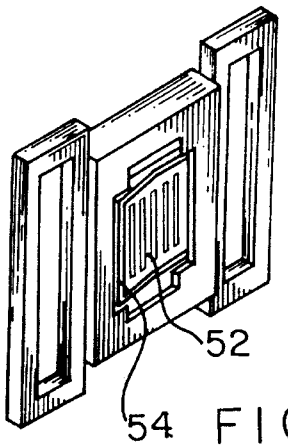
FIG. 5 is a perspective illustration of a male and a female clip when joined.

Each female member is in a flat generally rectangular configuration. Each female member includes a recess 58 formed at its outboard end 42. Such recess extends inboardly thereof. It functions for the receipt of the outboard end 42 of the male member 34. The female members each have an opening 62 in one face for the receipt of the upstanding projection 54 of the male member. Locking between the male and female member is effected by the projection extending upwardly through the opening. Note FIGS. 5 and 6. This arrangement also allows for the depression of the upstanding projection 54 when locked for causing the plate 52 with its projection 54 to move it out of the opening. This orientation then permits the sliding of the male and female members away from each other to effect their separation.

An additional feature of the coupling is effected through a slanting cam surface 66 on the male member 34 at the outboard end of the upstanding projection 54. This feature allows the downward deflection of the projection 54 when the male member 34 is first inserted into the female member 36 and slid inwardly with respect thereto. The cam surface 66 will then cause the plate 52 to move downwardly so that the male member may be fully inserted into the female member. When so inserted, the projection and plate will resile upwardly into the opening and locking is effected.

Figure 7:
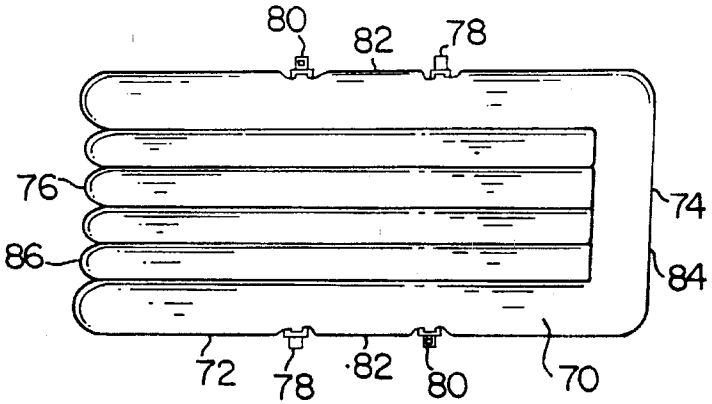
FIG. 7 is a plan view of an alternate embodiment of the invention.
Figure 4:
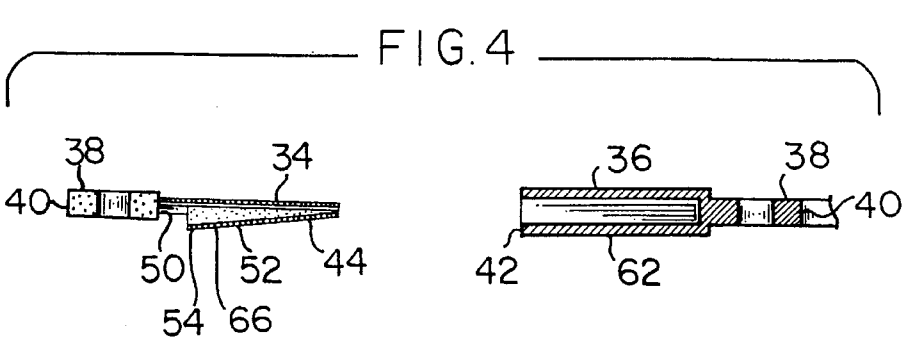
FIG. 4 is a cross sectional view of the clips shown in FIG. 3.

An alternate embodiment of the invention is shown in FIG. 7. Such alternate embodiment differs from the primary embodiment of FIGS. 1 through 6 in that the buoyant member 70 is formed in a rectangular configuration rather than the donut or torus-shaped configuration of the primary embodiment. In such rectangular configuration, the device has long parallel side edges 72 and short front and rear edges 74 and 76. The device is buoyant in that it is capable of floating, such floating preferably attained through inflation as in the primary embodiment.

The device of FIG. 7 also includes pairs of clips with a male clip 78 and a female clip 80 on each side of the device. In both embodiments, the clips on each side 82 of the device are such that the distance between the front 84 of the device and the adjacent two clips is the same as the distance between the rear 86 of the device and the adjacent two clips. This allows one of the devices to be rotated a 180 degrees with respect to the other and recoupled in such a manner that they remain in common side by side alignment.

Figure 9:
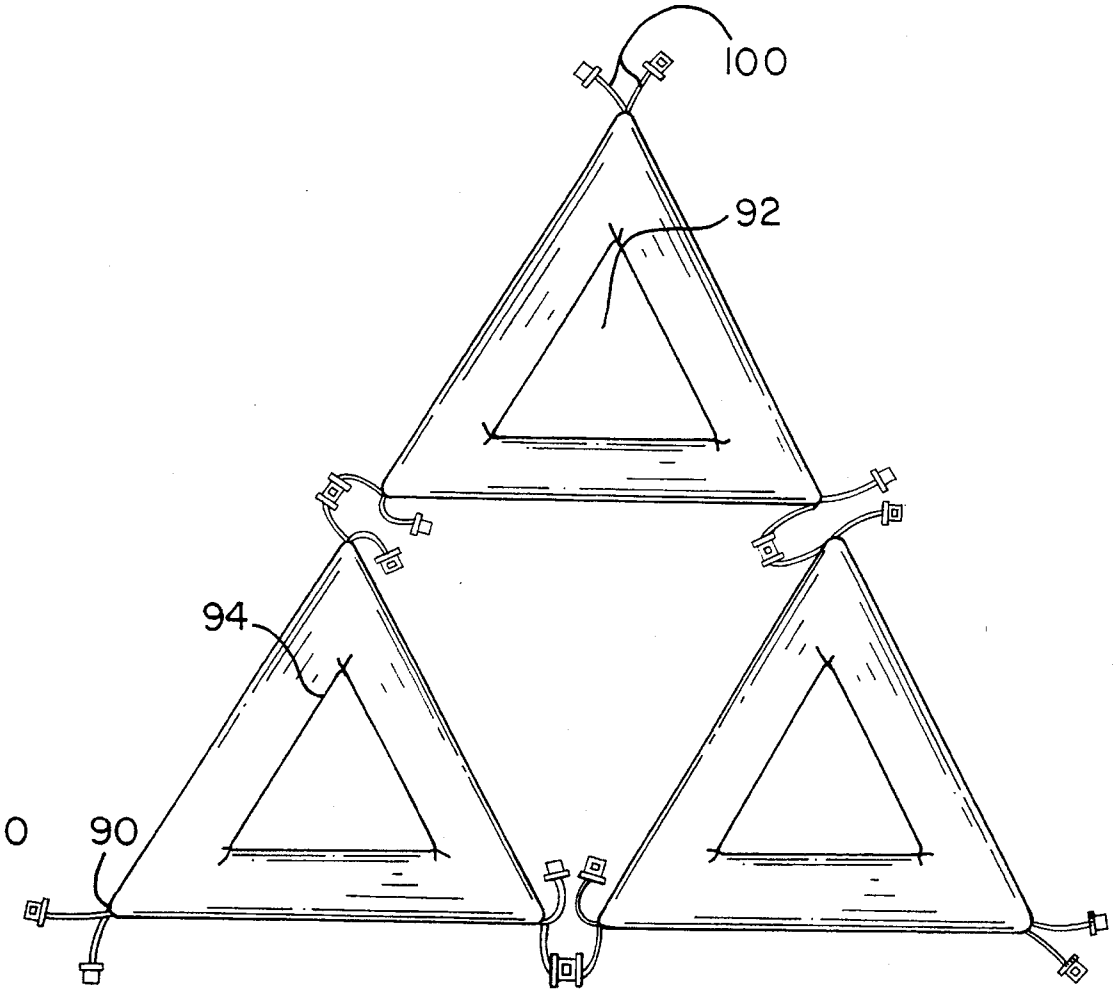
FIGS. 8 and 9 are plan views of yet another alternate embodiment of the invention.
Figure 8:
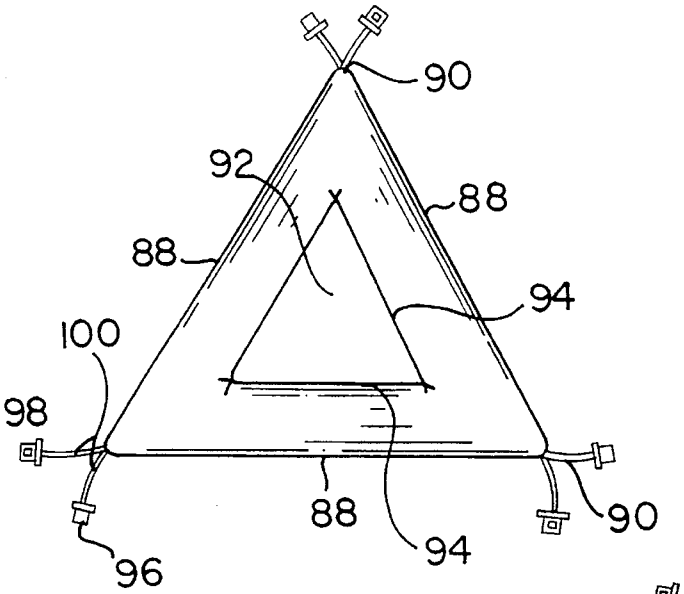

An additional alternate embodiment of the invention is shown in FIGS. 8 and 9. Unlike the prior embodiments, the present embodiment utilizes a unique triangular configuration with three symmetrical side edges 88. The symmetrical side edges extend outwardly to form three equiangular outer corners 90. The device also includes a triangular inner aperture 92 with outer edges 94 parallel to the corresponding symmetrical side edge 88. In addition, the triangular alternate embodiment also shows a pair of clips comprising a male end 96 and a female end 98. Both male and female ends are located at each of the three outer corners 90. Each pair of clips attach to the outer corner 90 by dual flexible members 100. Such a configuration of clips enhance the utility of the device by providing a plurality of unique combinations. This is mainly due to the fact that for required attachment of two devices it is necessary for only one clip to be utilized. This leaves an additional clip to be used for additional attachments.

It should be understood that any type of clips or equivalent device could be readily utilized in place of the clips as disclosed herein. Any number of equivalent clips or other devices could readily perform the intended function in the apparatus of the present invention.

In the device of the subject invention, whether the primary or alternate embodiment, the clips are set in two pairs, one pair on each side of the device with a male/female clip for each pair. This clip arrangement allows the side by side coupling as illustrated herein. It also allows one aquatic device to be rotated 180 degrees, front to back, with respect to the other device for greater utility of coupling than previously allowed. The clips of the subject invention are at or approximately at the mid-plane of each device. This allows inverting the devices for use in an upside down manner for even greater utility.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An aquatic system with a plurality of pneumatic devices and with releasable coupling components between the devices comprising, in combination:

a plurality of inflatable inner-tubes, each inner-tube being formed in a donut-shaped configuration with a central circular aperture therethrough and with a major axis extending through the center of the central aperture, the cross sectional configuration of each inner-tube being essentially circular with a circular central minor axis, each inner-tube having peripheral material in a central plane wherein the central plane contains the minor axis and is perpendicular to the major axis;

a pair of channels formed in the peripheral material at diametrically opposite regions of each inner tube, the channels at each region having tangential linear openings in the central plane and spaced about the periphery of the inner-tube; and a plurality of clips in pairs on diametrically Opposed regions of each inner tube, each pair including a male clip and a female clip, each clip having an inboard post secured within the opening of an associated channel, each clip also having an outboard end, the outboard ends of the clips for each pair including a male component and a female component.

2. An aquatic pneumatic device with releasable coupling components comprising:

an inner-tube formed in a donut-shaped configuration with a central circular aperture therethrough and with a major axis extending through the center of the central aperture, the cross sectional configuration of the inner-tube being essentially circular with a circular central minor axis, the inner-tube having peripheral material in a central plane wherein the central plane contains the minor axis and is perpendicular to the major axis;

a plurality of clips in pairs on diametrically opposed regions of the inner tube, each clip having an inboard end attached to the peripheral material, each clip also having an outboard end, the clips each being of a common length and with an intermediate extent at a location with respect to the inner tube whereby a straight line connecting the intermediate extents of each pair passes through the inner tube, the clips of each pair being spaced by a close first circumferential distance with each pair of clips being spaced from the other pair of clips by a far second circumferential distance greater than the first circumferential distance.

* * * * *

UNITED STATES PATENT AND TRADEMARK OFFICE

CERTIFICATE OF CORRECTION

PATENT NO. : 5,507,674
DATED : April 16, 1996
INVENTOR(S) : Man Fu Yeung

It is certified that error appears in the above-indentified patent and that said Letters Patent is hereby corrected as shown below:

On the title page, Item [75] Inventor: delete "Man F. Yeung" and insert therefor --Man Fu Yeung--.
Item [19], "Yeung" should read --Fu Yeung--.

Signed and Sealed this
Sixteenth Day of July, 1996

*Attest:*

*Attesting Officer*

Bruce Lehman

BRUCE LEHMAN

*Commissioner of Patents and Trademarks*